US006903734B2

(12) United States Patent
Eu

(10) Patent No.: US 6,903,734 B2
(45) Date of Patent: Jun. 7, 2005

(54) DISCHARGING APPARATUS FOR LIQUID CRYSTAL DISPLAY

(75) Inventor: Jung-Taeck Eu, Kyungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 247 days.

(21) Appl. No.: 09/893,985

(22) Filed: Jun. 29, 2001

(65) Prior Publication Data

US 2002/0080133 A1 Jun. 27, 2002

(30) Foreign Application Priority Data

Dec. 22, 2000 (KR) ..... P2000-79984

(51) Int. Cl.[7] ..... G09G 5/00

(52) U.S. Cl. ..... 345/211; 345/214; 345/98; 345/100

(58) Field of Search ..... 345/211, 212, 345/213, 214, 87, 90, 92, 96, 98, 100

(56) References Cited

U.S. PATENT DOCUMENTS 5,572,735 A * 11/1996 Tanikawa ..... 395/750
5,793,346 A * 8/1998 Moon ..... 345/92
5,945,970 A * 8/1999 Moon et al. ..... 345/92
6,064,360 A * 5/2000 Sakaedani et al. ..... 345/92

FOREIGN PATENT DOCUMENTS

JP 10-282471 A 10/1998

* cited by examiner

*Primary Examiner*—Regina Liang
*Assistant Examiner*—Jennifer T. Nguyen
(74) *Attorney, Agent, or Firm*—Morgan Lewis & Bockius LLP

(57) ABSTRACT

A discharging apparatus for a liquid crystal display is provided for substantially reducing a residual image upon power-off. In the apparatus, a gate driver integrated circuit selectively applies first and second gate voltages to gate lines of the display. A discharge circuit is coupled to the gate driver integrated circuit and senses a power-off state of a power supply line. When a power-off state is sensed, a short-circuit if formed between the first gate voltage supply line and the second gate voltage supply line, thereby discharging voltages on the gate lines. Accordingly, a gate low voltage relative gate high (pixel turn-on) voltage is discharged upon power-off to define a discharge path via the gate line, thereby rapidly discharging electric charges charged in the liquid crystal display panel.

7 Claims, 5 Drawing Sheets

DISCHARGING APPARATUS FOR LIQUID CRYSTAL DISPLAY

This application claims the benefit of Korean Patent Application No. P00-79984, filed on Dec. 22, 2000, which is hereby incorporated by reference.

BACKGROUND OF THE INVENTION

1. Field of the Invention

This invention relates to a thin film transistor (TFT) liquid crystal display, and more particularly, to a discharging apparatus for a liquid crystal display for substantially reducing a residual image upon power-off.

2. Description of the Related Art

Generally, a liquid crystal display (LCD) of active matrix driving system uses thin film transistors (TFT's) as switching devices to display a natural-like moving picture. Since such an LCD device can be made smaller than an existing Brown tube, it has been widely used as a monitor for personal or notebook computers, as well as in office automation equipment, such as copy machines, facsimile machines, and the like; and in portable equipment such as cellular phones and pagers, and the like.

An active matrix LCD device displays a picture by controlling light transmissivity within pixel cells of the liquid crystal device in accordance with an electric field applied to the liquid crystal of each cell. However, an existing problem of active matrix LCD's is that a voltage across a liquid crystal cell slowly decreases just after power to the device is turned off. This slow voltage decrease causes an undesirable residual image in the display after the display device is turned off (after power-off).

FIG. 1 shows one method currently used for overcoming the problem of residual LCD image after power-off. As shown in FIG. 1, a liquid crystal display panel is provided with discharge circuits 12 to eliminate LCD residual image when the device is powered off. The LCD panel includes a TFT arranged at each intersection between a gate line GL and a data line DL. Each of the TFT's includes a liquid crystal cell Clc connected between its drain and common voltage source Vcom. An auxiliary capacitor Cst is connected in parallel to each of the liquid crystal cell Clc, and each of the discharge circuits 12 is connected to one of the gate lines GL.

To operate a pixel defined at an intersection of a gate line GL and data line DL, a gate signal, e.g., a gate high voltage and a gate low voltage from a gate driver (not shown), may be applied to the gate line GL. At the same time, data voltage from a data driver (not shown) may be applied to the data line DL. The TFT is turned on when a gate high voltage is applied to the gate line GL. Consequently, the liquid crystal cell Clc is charged by the voltage difference between the data voltage from the data line DL and the common voltage Vcom. The liquid crystal cell Clc maintains voltage charge during a period when a gate low voltage Vgl is applied to the gate line GL, and the auxiliary capacitor Cst allows stable maintenance of the voltage charged in the liquid crystal cell Clc.

The discharge circuit 12 includes a PMOS transistor M1 for defining a discharge path upon power-off, a diode D1, and a capacitor C2 connected to the PMOS transistor M1. The capacitor C1 is connected between a voltage supply line VDDL and a gate terminal of the PMOS transistor M1. The diode D1 is connected between the gate of the PMOS transistor M1 and the source of the PMOS transistor connected to a ground line GNDL. The diode D1 and the capacitor C1 sense power-on/off by a supply voltage VDD from the voltage supply line VDDL to turn off or on the PMOS transistor M1. Upon power-off, the PMOS transistor M1 is turned on to define a discharge path for the liquid crystal cell Clc and the auxiliary capacitor Cst. Thus, upon power-off, a fast discharge of the liquid crystal cell Clc and the auxiliary capacitor Cst in the LCD eliminates a residual image on the LCD.

However, the conventional power-off discharge circuit has a drawback in that the liquid crystal display panel has a complicated structure since the discharge circuit 12 is provided on the liquid crystal display panel for each gate line GL. Moreover, since both the voltage supply line VDDL and the ground line GNDL for each discharge circuit 12 are formed on the liquid crystal display panel, the corresponding increase in the number of electrode lines complicates the liquid crystal panel display structure and adds to manufacturing complexity and costs. Thus, there remains a need in the art for a simple, low cost liquid crystal display structure that is capable of reducing residual image upon power-off.

SUMMARY OF THE INVENTION

Accordingly, the present invention is directed to a liquid crystal display that substantially obviates one or more of the problems due to limitations and disadvantages of the related art.

One aspect of the present invention is a discharging apparatus for a liquid crystal display that is capable of simplifying a structure of a liquid crystal display panel.

Another aspect of the present invention is a discharging apparatus for a liquid crystal display that rapidly discharges a voltage charge of a liquid crystal cell through a gate line upon power-off.

Yet another aspect of the present invention is providing discharging circuitry for a liquid crystal display device that is separate from the display device.

In order to achieve these and other aspects of the invention, a discharging apparatus for a liquid crystal display according to an embodiment of the present invention includes a first gate voltage supply line, a second gate voltage supply line, a power supply line, and gate driver integrated circuitry for selectively applying first and second gate voltages supplied from the first and second gate voltage line to gate lines of the display. The discharging apparatus includes circuitry for sensing whether power provided to the display from the power supply line is on or off. In response to sensing an off state, the circuitry forms a short between the first gate voltage supply line and the second gate voltage supply line to discharge voltages on the gate lines. The discharge circuitry may be provided on a printed circuit board to be connected to the gate driver integrated circuitry.

It is to be understood that both the foregoing general description and the following detailed description are exemplary and explanatory only and are intended to provide further explanation of the invention, as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments of the invention, examples of which are illustrated in the accompanying drawings. Whenever possible, the same reference numbers will be used throughout the drawings to refer to the same or like parts.

Figure 1:
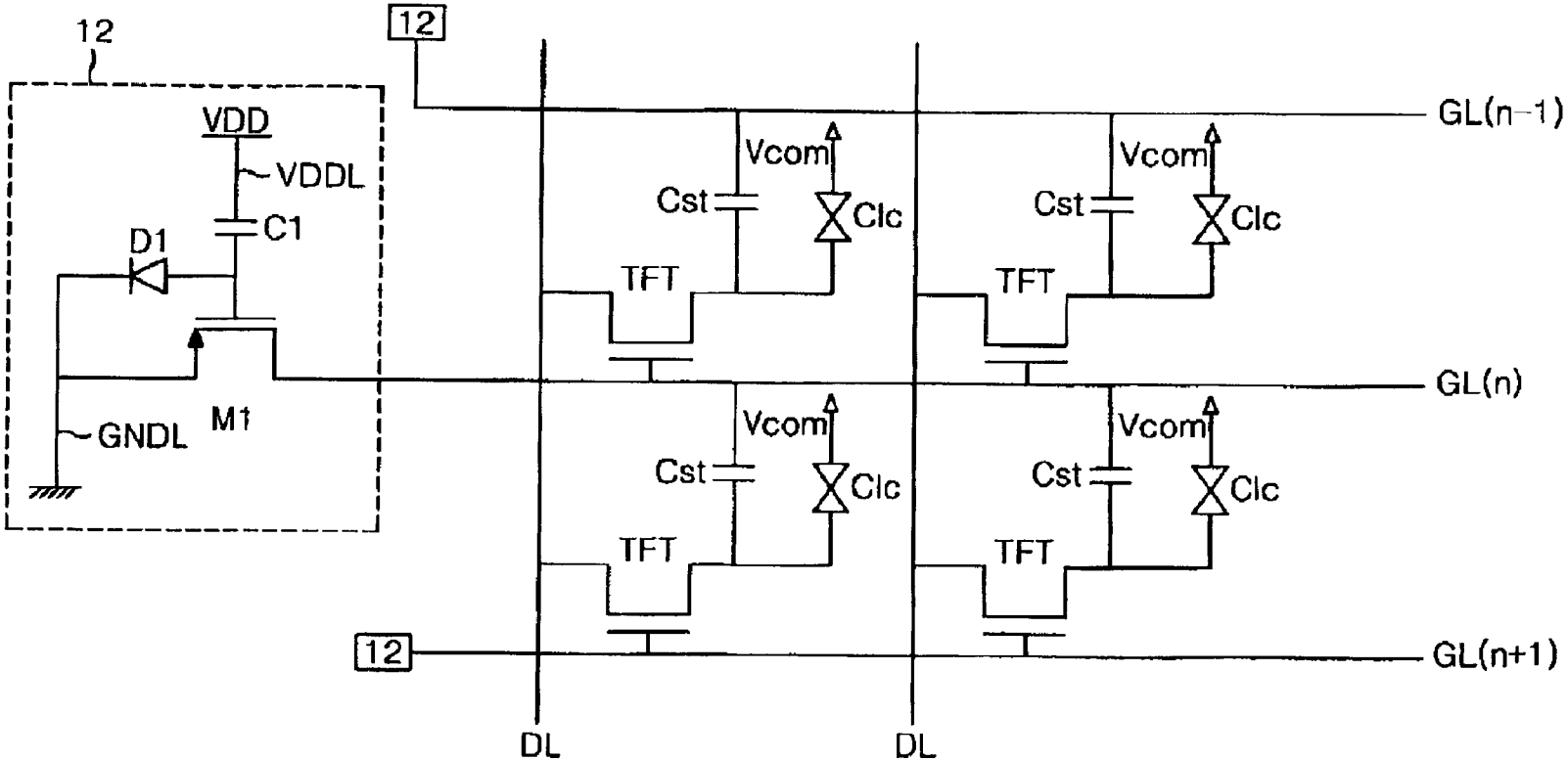
FIG.1 CONVENTIONAL ART
FIG. 1 provides a simplified schematic circuit diagram of a liquid crystal display panel including a conventional power-off discharge circuit.
Figure 2:
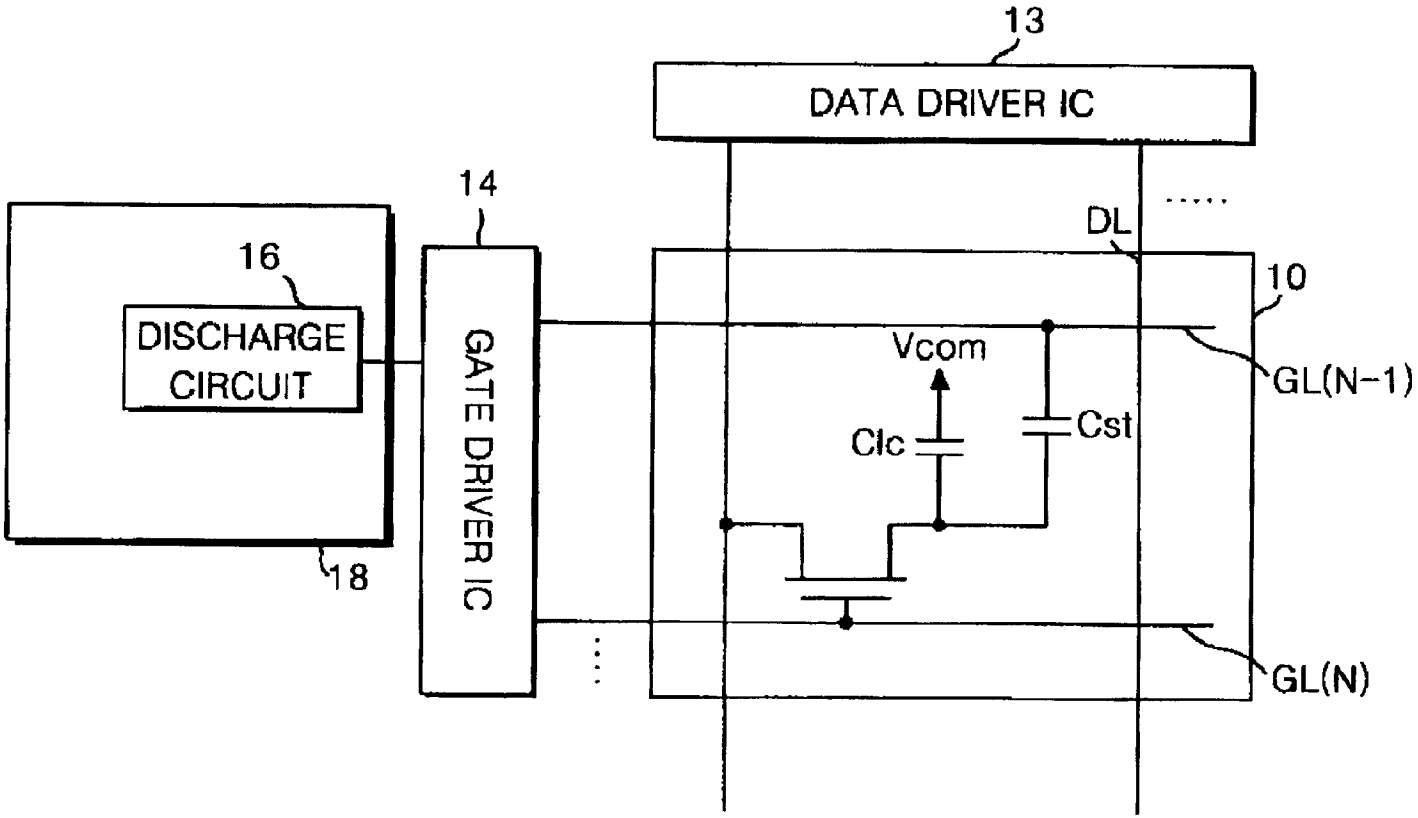
FIG. 2 provides an illustrative block circuit diagram of a liquid crystal display arrangement according to an exemplary embodiment of the present invention.

Referring to FIG. 2, there is shown a liquid crystal display (LCD) including a discharge circuit according to an embodiment of the present invention. The LCD includes a liquid crystal display panel 10 for displaying a picture, a data driver integrated circuit (IC) 13 for driving data lines DL of the liquid crystal display panel 10, a gate driver IC 14 for driving gate lines GL of the liquid crystal display panel 10, and a discharge circuit 16 connected to the gate driver IC 14.

FIG. 2 shows an exemplary circuit of one pixel of a plurality of pixels that are included in the liquid crystal display panel 10. As shown in FIG. 2, each pixel circuit may include a TFT arranged at intersections between a gate line GL(N) and a data line DL, a liquid crystal cell Clc connected between the drain of the TFT and the common voltage source Vcom, and an auxiliary capacitor Cst connected to the liquid crystal cell Clc (and the drain of the TFT) and the pre-stage gate line GL(N−1).

In the forgoing exemplary pixel circuit, a gate signal applied to gate line GL may include one of a gate high voltage Vgh and a gate low voltage Vgl (relative the gate high voltage) from the gate driver IC 14. A data voltage from the data driver 13 may be applied to the data line DL. A gate high voltage Vgh applied to the gate line GL turns on the TFT to create a voltage difference between the data line DL voltage and the common voltage Vcom applied to the liquid crystal cells Clc. The liquid crystal cell Clc of a panel pixel may then maintain the voltage charged during a period when a gate low voltage Vgl is applied to the gate line GL. The auxiliary capacitor Cst assists in stable maintenance of the voltage charged in the liquid crystal cell Clc.

Figure 3:
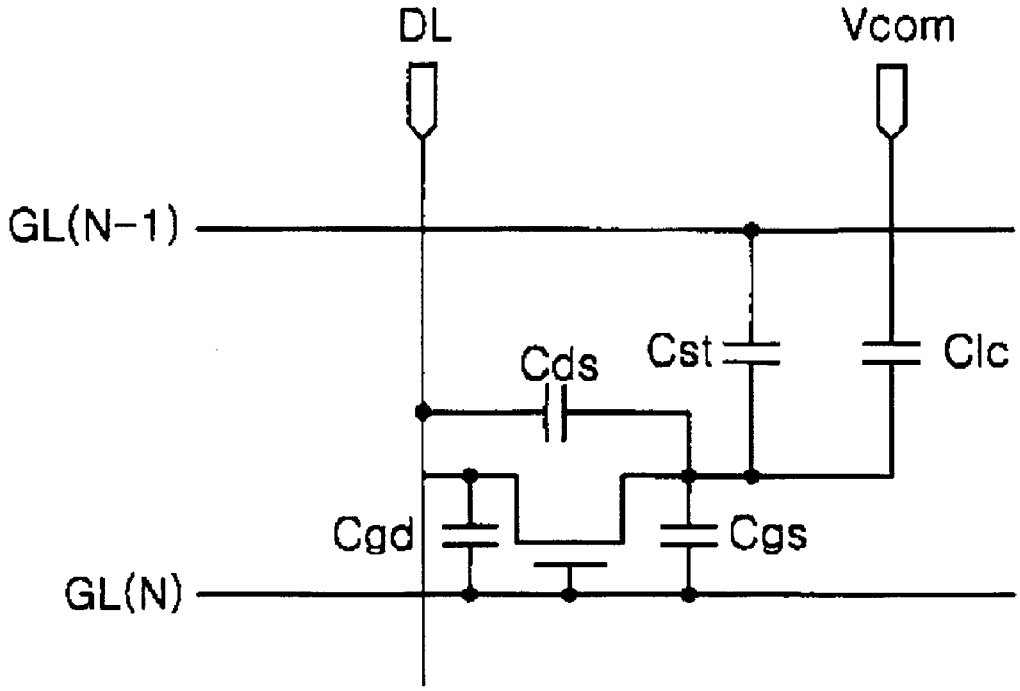
FIG. 3 is an equivalent circuit diagram of the unit pixel shown in FIG. 2.

FIG. 3 shows an equivalent circuit model for the TFT of FIG. 2. Generally, the TFT has an overlapping portion between its gate terminal and its source terminal and between its gate terminal and its drain terminal. The TFT consequently has parasitic capacitances Cgs and Cgd. There also is a parasitic capacitance Cds and a parasitic resistance (not shown) that exist between the TFT source and drain terminals. The parasitic resistance is an equivalent resistance when the TFT is turned off, and is not constant during operation.

The data driver IC 13 and the gate driver IC 14 are driven with a control signal from a controller (not shown). The data driver IC 13 and the gate driver IC 14 may include a plurality of PMOS or NMOS transistors, for example. The data driver IC 13 and the gate driver IC 14 may be provided in a package, such as a tape carrier package (TCP) that is connected to the liquid crystal display panel 10 by a bonding process of the TCP. However, driver circuitry of present invention may be provided using other methods of packaging, such as those utilizing ball grid arrays (BGA), chip scale packaging (CSP), flip chip methods of packaging, and/or other packaging methods utilizing corresponding bonding and/or wiring methods.

The discharge circuit 16 may be formed on a printed circuit board (PCB) 18 provided with a controller and/or other related circuitry (not shown). The discharge circuit 16 senses when a power-off condition exists to define a discharge path passing through the gate driver IC 14 to gate line GL, thereby rapidly discharging a voltage charged in the liquid crystal cell Clc and the auxiliary capacitor Cst upon power-off.

Figure 4:
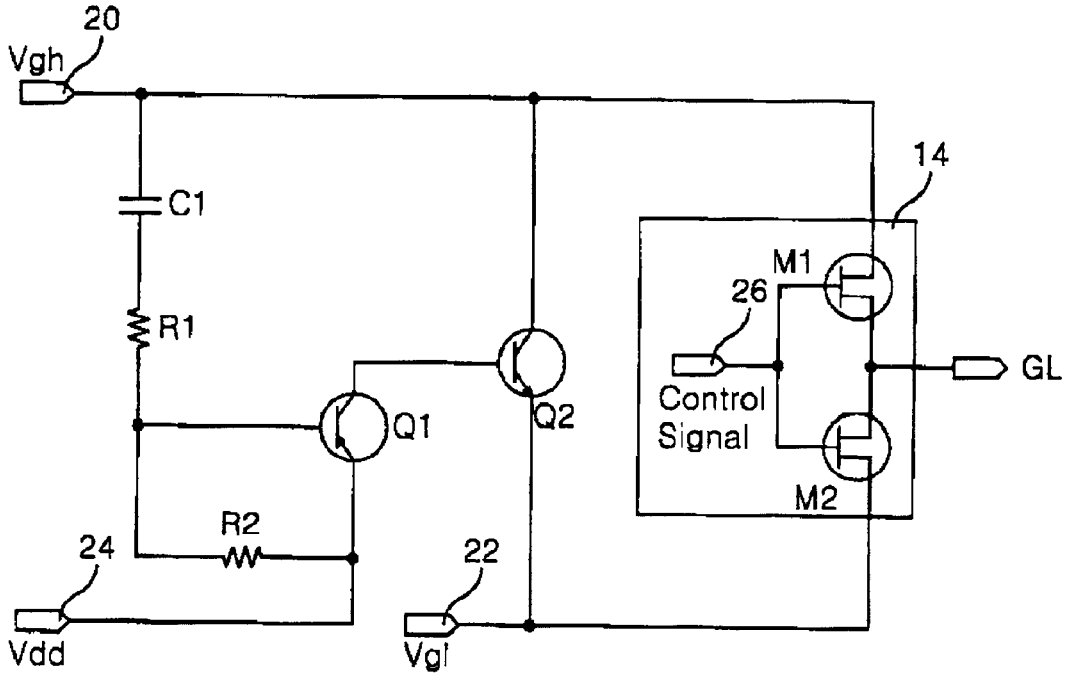
FIG. 4 provides an illustrative circuit arrangement of the exemplary discharge circuit and gate driver integrated circuit shown in FIG. 2.
Figure 5:
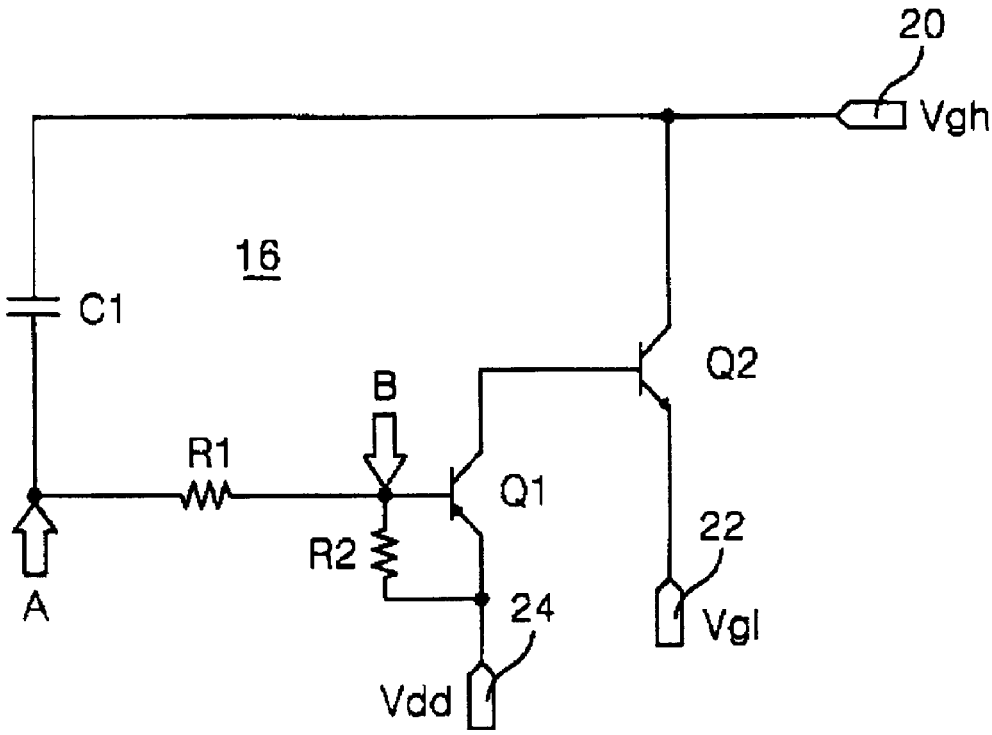
FIG. 5 provides an exemplary circuit diagram further illustrating the discharge circuit shown in FIG. 4.

FIG. 4 shows an exemplary circuit arrangement including the discharge circuit 16 and the gate driver IC 14 shown in FIG. 2. FIG. 5 shows a portion of the circuit arrangement of FIG. 4 that includes details of the discharge circuit 16 for purposes of explaining the present invention.

In FIG. 4, the gate driver IC 14 may include an NMOS transistor M1 connected between a first input line 20 and the gate line GL, and a PMOS transistor M2 connected between a second input line 22 and the gate line GL. The first input line 20 supplies the gate high voltage Vgh, and the second input line 22 supplies the gate low voltage Vgl. The gate electrodes of the NMOS transistor M1 and the PMOS transistor M2 are connected to a control signal input line 26. The NMOS transistor M1 and the PMOS transistor M2 are selectively turned on in response to a control signal from the control signal input line 26. Thus, the NMOS transistor M1 and the PMOS transistor M2 allow the gate high voltage Vgh from the first input line 20 and the gate low voltage Vgl from the second input line 22 to be selectively applied to the gate line GL.

In the exemplary circuit arrangement shown in FIG. 4 and FIG. 5, when the discharge circuit 16 senses a power-off condition of a third input line 24, a short is formed between the first input line 20 and the second input line 22 to define a discharge path. The exemplary discharge circuit 16 includes an NPN-type transistor Q2 connected between the first and second input lines 20 and 22, and a power-off sensor for sensing a power-off in the voltage supply line 24 to turn on the NPN-type transistor Q2. The power-off sensor includes a PNP-type transistor Q1 connected between the voltage supply line 24 and the base of the NPN-type transistor Q2. A capacitor C1 and a resistor R1 are connected in series between the first input line 20 and the PNP-type transistor Q1. A resistor R2 is connected between the base and the emitter of the PNP-type transistor Q1.

In the exemplary discharge circuit embodied in FIGS. 4 and 5, a supply voltage Vdd supplied over the voltage supply line 24 upon power-on may be set to approximately +7V to +10V. A gate high voltage Vgh applied over the first input line 20 may be set to a TFT turn-on voltage of about +18V to +25V, while a gate low voltage Vgl applied over the second input line 22 may be set to a TFT turn-off voltage of about −5V to −8V, for example. Of course, it is to be understood that the ranges of voltages described above are exemplary and that other voltage levels and ranges may be used depending on a particular type of switch, a switch arrangement, the threshold levels of switches used in a particular switch arrangement, and/or a particular operating power range of a display.

When a supply voltage Vdd is applied over the voltage supply line 24 by power-on, a base voltage of the PNP-type transistor Q1 becomes equal to its emitter voltage and the PNP-type transistor Q1 is turned off. Thus, the NPN-type transistor Q2 also is turned off to allow selective application of the gate high voltage Vgh or the gate low voltage Vgl to the gate line GL. In this case, since the base voltage of the PNP-type transistor Q1, i.e., the voltage at a node B, is equal to the emitter voltage Vdd, a voltage of −(Vgh−Vdd) is generated across the capacitor C1 (coupled with the gate high voltage Vgh from the first input line 20).

On the other hand, when a ground potential is applied to the voltage supply line upon power-off, the voltage −(Vgh−Vdd) charged in the capacitor C1 is shifted into a ground voltage (or 0V). Thus, a voltage at the node A between the capacitor C1 and the resistor R1 is shifted in a direction contrary to the direction of the voltage −(Vgh−Vdd) already charged in the capacitor C1. In other words, the voltage at the node A is shifted into a negative voltage relative the supply voltage Vdd applied upon power-on. If a voltage at node A drops, as described above, then a voltage at node B generated by the two resistors R1 and R2 acting as a voltage divider is applied to the base of PNP-type transistor Q1. Accordingly, the PNP-type transistor Q1 is turned on to supply current to the base of NPN-type transistor Q2. The base current in transistor Q2 from transistor Q1 turns on transistor Q2 and short-circuits the first input line 20 and the second input line 22. As a result, the gate low voltage Vgl, for example, of approximately −5V to −8V, is discharged at a high speed to rapidly discharge a voltage charged in the liquid crystal cell Clc and the auxiliary capacitor Cst via the gate line GL.

As described in the above exemplary embodiment, according to the present invention, a gate low voltage is discharged upon power-off to define a discharge path via the gate line, thereby rapidly discharging electric charges charged in the liquid crystal display panel. Moreover, the discharge circuit according to the present invention may be provided on a PCB to be connected, via the gate driver IC, to the gate line of the liquid crystal display panel. Accordingly, it becomes possible to simplify a configuration of the liquid crystal display panel in comparison to the conventional discharge circuit provided on the liquid crystal display panel.

It will be apparent to those skilled in the art that various modifications and variations can be made for the discharging apparatus for liquid crystal display of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A discharging apparatus for a liquid crystal display including a plurality of liquid crystal pixel cells, each of the liquid crystal cells being arranged at an intersection between one of a plurality of gate lines and one of a plurality of data lines, and switching devices for driving the liquid crystal cells in response to a signal from each gate line, the discharging apparatus comprising:

a first gate voltage supply line;

a second gate voltage supply line;

a power supply line;

gate driver circuitry for selectively applying to the gate lines first and second gate voltages supplied from the first and second gate voltage supply lines, respectively; and a discharge circuit for sensing a power-off condition of the power supply line to short-circuit the first gate voltage supply line and the second gate voltage supply line when the power-off condition is sensed, thereby discharging voltages on the gate lines.

2. The discharging apparatus according to claim 1, wherein the first gate voltage is a positive gate high voltage, and the second gate voltage is a gate low voltage, and the gate low voltage is negative relative the positive gate high voltage.

3. The discharging apparatus according to claim 2, wherein said discharge circuit includes:

power-off sensing circuitry for sensing the power-off condition of the power supply line; and a switching device for short-circuiting the first and second gate voltage supply lines upon power-off in response to a control signal from the power-off sensing circuitry.

4. The discharging apparatus according to claim 3, wherein said discharge circuit includes:

a capacitor for charging to a desired voltage when a power voltage is being applied from the power supply line and discharging the charged desired voltage upon the power-off condition; and a switching control device for controlling the switching device in response to the desired voltage discharged from the capacitor.

5. The discharging apparatus according to claim 4, wherein the desired voltage charged in the capacitor comprises a voltage difference between the gate high voltage and the power voltage, and the capacitor discharges the desired voltage upon the power-off condition.

6. The discharging apparatus according to claim 4, wherein said switching device is a NPN-type transistor, and said switching control device is a PNP-type transistor.

7. The discharging apparatus according to claim 1, wherein the discharge circuit is provided on a printed circuit board and connected to the gate driver circuitry.

* * * * *